United States Patent [19]

Jamieson, Jr.

[11] 4,369,963

[45] Jan. 25, 1983

[54] CLIP-ON STAR WHEEL SUBSTITUTE

[75] Inventor: H. William Jamieson, Jr., Encino, Calif.

[73] Assignee: Offset Engineering Co., Inc., Encino, Calif.

[21] Appl. No.: 104,500

[22] Filed: Dec. 17, 1979

[51] Int. Cl.[3] ..... B65G 29/00

[52] U.S. Cl. ..... 271/204; 198/648

[58] Field of Search ..... 271/204, 205, 206; 198/648, 731, 844; 101/232, 408; 403/235, 233, 190, 191; 24/259 FS, 259 RC

[56] References Cited

U.S. PATENT DOCUMENTS

| | | | |
|---|---|---|---|
| 2,025,481 | 12/1935 | Stussi | 271/204 |
| 2,665,869 | 1/1954 | Samuels | 24/254 |
| 3,713,649 | 1/1973 | van Kempen et al. | 271/204 |

FOREIGN PATENT DOCUMENTS

| | | | |
|---|---|---|---|
| 10134 | 8/1956 | Fed. Rep. of Germany | 198/844 |

*Primary Examiner*—John J. Love
*Assistant Examiner*—Brian Bond
*Attorney, Agent, or Firm*—Nilsson, Robbins, Dalgarn, Berliner, Carson & Wurst

[57] ABSTRACT

As a substitute for the transfer or star wheel, for preventing paper wrinkling in the chain delivery section of a printing apparatus, which chain delivery section has a pair of continuous chains upon which chains are mounted a plurality of paper gripping members, wherein the chains include a plurality of pairs of links pivotally attached by pintles, an improvement comprising a pair of opposing clips detachably mountable on a link on the respective one of the chains, without the need for adding a protrusion to the link or pintle, and including a support, a bar fixedly engaged by the supports against rotation about the longitudinal axis of the bar and paper contacting members longitudinally adjustably mounted on the bars. Also disclosed is the paper contacting members being eccentric in shape and having a bearing surface with the eccentric being rotatably adjustable about the longitudinal axis and held against further rotation during operation of the chain delivery.

5 Claims, 6 Drawing Figures

FIG. 2
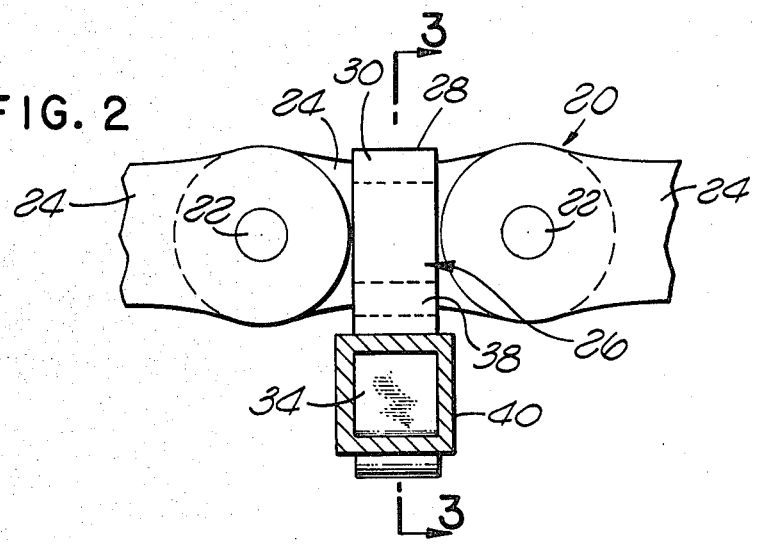
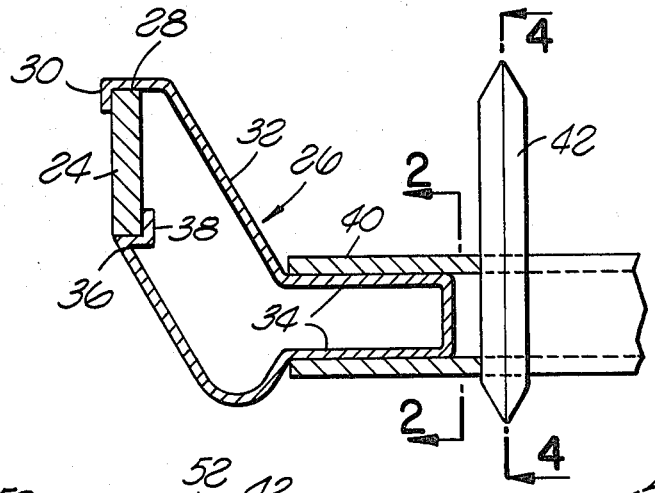
FIG. 3
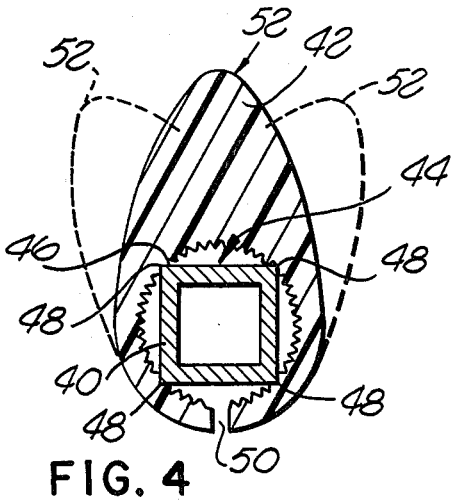
FIG. 4
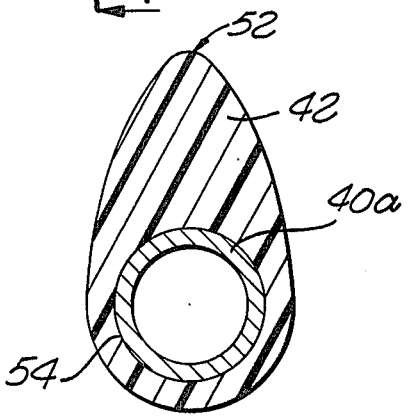
FIG. 5

CLIP-ON STAR WHEEL SUBSTITUTE

BACKGROUND OF THE INVENTION

This invention relates generally to a novel means of preventing the paper in a chain delivery section of a printing apparatus from wrinkling by substituting the apparatus of the present invention for the so-called star wheel or star wheels of the prior art. More particularly, the invention concerns an improvement in, e.g., the chain delivery section of a printing apparatus, which chain delivery section has a pair of continuous chains, upon which chains are mounted a plurality of paper griping members, wherein the chains include a plurality of pairs of links pivotally attached by pintles, comprising a pair of opposing clips detachably mountable on a link on the respective ones of the chains, without the need for adding a protrusison to the link or pintle, and including a and paper contacting members longitudinally adjustably mounted on the bar. This system allokws for speedy adjustment of both the placement of the bar along the chains and the contacting members along the bar.

In the past, it has been common to prevent wrinkling of the paper as it is transported onto, e.g., the chain delivery section, where it is gripped by the paper gripping members to be transported by the chain delivery section to a point where the paper gripping members release the paper and deposit it in a desired location, by using a so-called star wheel or star wheels which press against the paper and the cylinder which is delivering the paper to the chain delivery section at a point or points between the paper gripping members. However, should the bearing surfaces on the star wheels contact the paper at a point at which it has just freshly been printed, a series of visible marks or tracks will be left by the wheel where it has contacted the print.

It is therefore desirable to be able to adjust, with as much flexibility as possible, the points at which the star wheel, or other means of preventing the paper from wrinkling, contacts the printed sheets.

One manner of accomplishing this is shown in the patent to Stussi, U.S. Pat. No. 2,025,481, issued on Dec. 24, 1935. In the patent to Stussi there is shown a bar or axle which extends between protrusions extending from the pintles of one or more of the links in the chain drive chains. On the bar or axle are mounted a plurality of disc-shaped paper contacting members which are adjustable longitudinally along the bar or axle.

While such arrangements have exhibited at best a degree of utility in providing the necessary flexibility for adjusting the contact points on the printed sheets, room for significant improvement remains. One problem which exists with the apparatus shown in the patent to Stussi is that the chain drive must be modified to provide the protrusions from the pintles, and unless such protrusions are placed on each pintle throughout the chain in the chain drive, a degree of flexibility in locating the contact point is lost due to inability to select discrete positions for the bar or axle throughout the length of the chain drive. The second problem which exists in the apparatus shown in the patent to Stussi is that, because the axle or bar can only be located at a plurality of discrete locations, based on the spacing of the protrusions from the pintles, and because the paper contacting members are disc-shaped, rather than eccentric the contacting points can only be adjusted along a plurality of discrete lines running transverse to the paper passing through the printing apparatus, by moving the paper contacting members longitudinally along the bar or axle. This is because the location of the bar or axle is fixed to a plurality of discrete positions along the chain drive and the disc shape of the paper contacting members fixes a single point at which the disc will contact the paper for any given bar location. Another problem which exists in the patent to Stussi, besides the lack of flexibility in the location of the contacting points, is the down time created by the necessity for unscrewing the bar or axle to remove it from the protrusions and the replacement of the bar or axle on a different pair of protrusions in order to adjust for different printing patterns in successive printing runs. Other methods of fixing crosspieces allow for attachment without modification of the chain, but suffer from this same setback of excessive time required for repositioning the crosspiece.

The problems enumerated in the foregoing are not intended to be exhaustive, but rather are among many which tend to impair the effectiveness of previously known means for preventing paper wrinkling as the paper is passed onto the chain delivery section of a printing apparatus. Other noteworthy problems also exist; however, those presented above should be sufficient to demonstrate that the prior art means for preventing paper wrinkling as the paper is passed onto the chain delivery section of a printing apparatus appearing in the art have not been altogether satisfactory.

SUMMARY OF A PREFERRED EMBODIMENT OF THE INVENTION

Recognizing the need for an improved means for preventing paper wrinkling as the paper is passed onto, e.g., a chain delivery section of a printing apparatus, it is therefore, a general feature of the present invention to provide a novel means for preventing paper wrinkling as the paper is passed onto, e.g., a chain delivery section of a printing apparatus, which minimizes or reduces the problems of the type previously noted.

A particular feature of the present invention resides in the use of a pair of opposing clips which are detachably mountable on a link on the respective one of the chains, with a minimum of time required for repositioning, and paper contacting members longitudinally adjustably mounted on the bar.

Another feature of the present invention resides in the paper contacting members being of eccentric shape, and having a bearing surface, with the eccentric being rotatably adjustable about the longitudinal axis and held against further rotation during the operation of the chain delivery section. The eccentric shape allowing selective positioning of the contact points with the paper.

Yet another feature of the present invention resides in the bar having a hollow portion which is fixedly engaged by inserting the support into the hollow portion or, the support having a hollow portion which is fixedly engaged by inserting the bar into the support's hollow portion.

Still another feature of the present invention resides in the paper contacting members being rotatably adjustable about the longitudinal axis of the bar and fixed against further rotation during operation of the chain delivery section, which is accomplished in one embodiment of the present invention by having the bar having a plurality of sides forming corners, at least one of which is fexedly engaged between two of a plurality of teeth contained on a portion of the paper contacting member which fits around and adjacent to the sides of the bar, and wherein the opening is selectively adjustable in size to allow disengagement of the corner or corners by the teeth to set the paper contacting member at a desirked position; and is accomplished in a second embodiment of the invention by having the bar be of cylindrical shape with the paper contacting member having a cylindrical internal opening of slightly smaller diameter than the diameter of the bar so that the paper containing member is forceably rotatable about the longitudinal axis of the bar to a desired position but is frictionally held at the desired position during operation of the chain delivery section.

Examples of the more important features of this invention have thus been summarized rather broadly in order that the detailed description thereof that follows may be better understood, and in order that the contribution to the art may be better appreciated. There are, of course, additional features of the invention that will be described hereafter and which will also form the subject of the appended claims.

BRIEF DESCRIPTION OF THE DRAWINGS

FIG. 2 shows a side elevational view, partially sectional along the lines shown in FIG. 3, of the clip and bar of the present invention;

FIG. 3 is a front elevational view, partially sectional along the lines shown in FIG. 2, with the added feature not shown in FIG. 2 of a paper contacting member according to the present invention;

FIG. 4 depicts a sectional view along the lines shown in FIG. 3 of a paper contacting member according to the present invention;

FIG. 5 depicts a second embodiment of the bar and paper contacting member according to the present invention; and, FIG. 6 shows an alternative embodiment of the connection between the clip and bar of the present invention as illustrated in FIG. 3.

DETAILED DESCRIPTION OF THE PREFERRED EMBODIMENTS OF THE INVENTION

Figure 1:
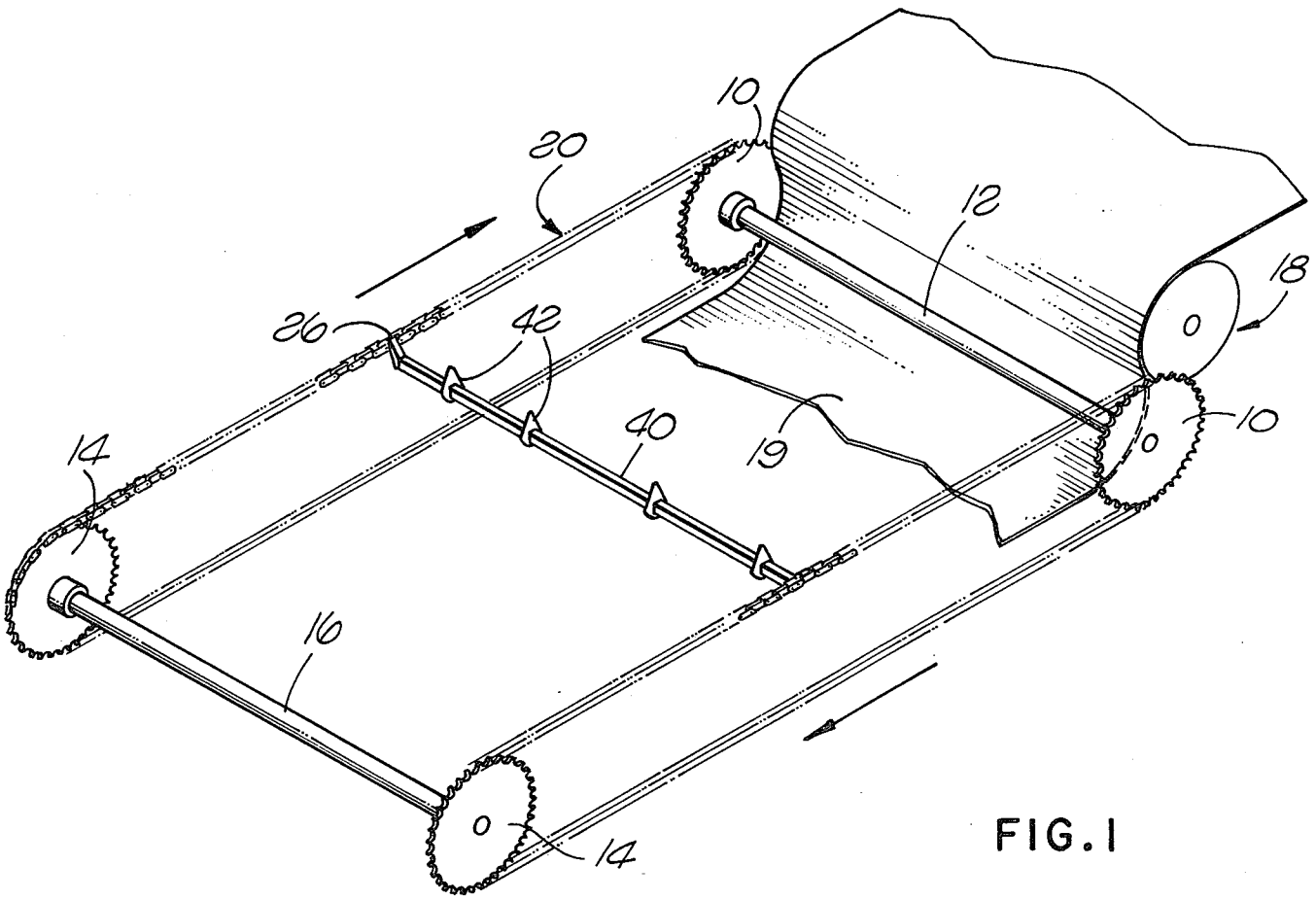
FIG. 1 depicts a schematic view of the chain delivery section according to the present invention.

Turning first to FIG. 1, a schematic view is shown of a chain delivery with which the present invention is used. The chain delivery consists of a pair of follower wheels 10 mounted on an axle 12 and a pair of drive wheels 14 mounted on an axle 16. A pair of chains 20, consisting of a plurality of links 24 (shown in FIG. 2), pivotally connected by pintles 22 (shown in FIG. 2), form continuous chains about drive wheels 14 and follower wheels 10. A cylinder or drum 18 feeds a paper sheet 19 into the chain delilvery where it is gripped by paper grippers (not shown) mounted on the chains 20, e.g., in the manner shown in the patent to Stussi noted above.

Turning now to FIG. 2 and FIG. 3, a single link 24 of the chain 20 is shown with portions of the adjacent links 24 and a clip 26 according to the present invention. The clip 26 has a top portion 28 having a flange 30 and a pair of brackets 31, which support an angle portion 32 connecting the top portion 28 to support 34 integrally formed by the clip 26. The clip 26 also has a bottom portion 36 and a flange 38 for acting in cooperation with the top portion 28 and flange 30 to detachably mount the clip 26 onto the link 24. It can readily be seen that the clip will attach quickly to any link 24 in the chain 20 without the need for any special modification or adaptation of the link 24 or the addition of any protrusions to the links 24 or the pintle 22.

A bar 40, which may be hollow over its entire length or hollow only to the extent necessary to allow support 34 to fit inside of the bar 40, fits over the external surfaces of the support 34, and is thereby fixedly engaged against rotation about the longitudinal axis of the bar 40. The bar 40 extends transversely across the chain delivery section to an opposing clip 26 (as shown in FIG. 1). Also shown in FIG. 3 is a paper contacting member 42 which is longitudinally slidably mounted on the bar 40 as will be further explained below.

Turning to FIG. 4, the paper contacting member 42 and its mounting on the bar 40 are shown in more detail. The paper contacting member 42 is shown to be an eccentric which has a bearing surface 52 at its apex and a hollow internal portion 44 with the surface of the internal portion 44 of the eccentric paper contacting member 42, which defines the hollow portion 44, having a plurality of teeth 46. The bar 40 has a plurality of sides which define corners, in the illustrated embodiment of FIG. 4, the bar 40 being rectangular with four corners, which are engaged between adjacent teeth 46 as shown at 48. A gap 50 exists in the lower portion of the eccentric paper contacting member 42 so that the internal opening 44 is adjustable in size by expanding the gap 50 to facilitate sliding the eccentric paper contacting member 42 longitudinally along the bar 40 and also rotating the eccentric paper contacting member 42 about the longitudinal axis of the bar 40 as shown by the phantom positions of the bearing surface 52 in FIG. 4.

Turning now to FIG. 5, a second embodiment of the present invention is illustrated in which a bar **40*a* is cylindrical in shape and the eccentric paper containing member 42 has a cylindrical internal opening having an inner surface 54 of slightly smaller diameter than the external surface of the bar 40*a*, such that the eccentric paper contacting member 42 is forceably slidable along the longitudinal axis of the bar 40*a* and forceably rotatable about the longitudinal axis of the bar 40*a*, upon the exertion of sufficient force, however, the eccentric paper contacting member 42** is frictionally bound against such longitudinal or rotational motion during the normal operation of the chain delivery.

Thus in operation the preferred embodiments of the present invention allow for detachably mounting the clip 26 onto any given link 24 of the chain 20 and the corresponding opposing link 24 on the opposite chain 20, with the bar 40, **40*a* fixedly engaged by the support 34 integral with the clip 26**. This thus allows a simple and expenditous changing of the position of the bar along the entire length of the chain.

In addition, it will be appreciated that the bearing su4face 52 of the eccentric paper contacting member 42 may be positioned along the longitudinal axis of the bar 40, **40*a* by sliding the eccentric paper contacting member 42 longitudinally along the bar 40 (or 40*a* as shown in FIGS. 1 and 5**).

In addition, the bearing surface 52 is rotatably adjustable about the longitudinal axis of the bar 40, **40*a*, but fixed against rotational movement during the normal operation of the chain delivery section. Therefore, the paper contacting members 42 of the present invention has two main degrees of movement for adjusting the contact point on the printed sheets, i.e., plurality of diskcrete locations along the links 24 of the chain 20, and longitudinally along the bar 40, 40***a*. In addition, a fine adjustment is possible by rotating the bearing surface 52 of the eccentric paper contacting member 42 with respect to the bar 40, 40*a*. However, once this rotational movement is accomplished to the desired position of the baring surface 52, the eccentric paper contacting member 42 of the present invention is held against further rotational movement during the operation of the chain delivery section. The combination of the possible adjustments of the bearing surface 52 of the eccentric paper contacting member 42 of the present invention allows for a very fine adjustment of the particular spot on the printed sheet at which any given one of the one or more eccentric paper contacting members 42, contained on any given one of a plurality of bars 40, 40*a*, will strike the sheet of paper 19 as it is fed into the chain delivery.

It will further be understood that in normal operation a plurality of bars 40, 40*a* will be attached between the chains by a plurality of pairs of clips 26.

Figure 6:
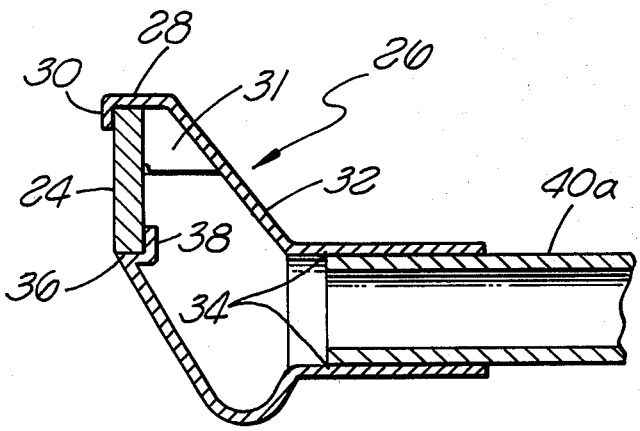

FIG. 6 depicts the view of the clip 26 and bar 40 as shown in FIG. 3 with two possible alternative embodiments. First, the support 34 is formed to have a hollow portion into which the bar 40*a* fits, with the hollow portion being of slightly smaller diameter than the bar 40*a* to thereby frictionally engage the bar 40*a* against rotation about its longitudinal axis or motion along its longitudinal axis. In addition, the alternative of having the hollow portion of the support 34 be cylindrical to accommodate a cylindrical portion of the bar 40, 40*a* is shown. This could be used with the multisided bar 40, by attaching to the edns thereof a cylindrical protrusion, and could also be used with the cylindrical bar 40*a*, but with the portion of the bar 40*a* which is inserted into the cylindrical hollow portion of support 34 not constituting the same outer surface of the bar 40*a* onto which the eccentric 42 is mounted, but, rather, a protrustion attached to the end of the bar 40*a* of suitable size to fit in and be frictionally bound by the hollow portion of the support 34.

SUMMARY OF THE ADVANTAGES AND SCOPE OF THE INVENTION

It will be appreciated that in construing a clip-on star wheel substitute according to the present invention, certain significant advantages are provided. In particular, the necessity for fabricating a chain with special protrusions thereon for mounting the bar, 40, 40*a*, as shown in the prior art, is eliminated. Also, repositioning of the bar can be done quickly and down time thus kept to a minimum.

Further, the clip 26 can attach to any of the links 24 in the chain 20, thereby providing a great flexibility for selection of discrete positions for the bar along the length of the chains 20.

Further, by providing an eccentric paper contacting member 42, which is rotatably adjustable to a desired position but held against rotational motion during operation of the chain delivery, an additional and precise adjustment may be made in the exact location where the bearing surface 52 of the individual paper contacting members 42 strikes the paper 19 as it enters the chain delivery section. Thus, wrinkling of the paper can be prevented and the bearing surfaces 52 can be adjusted to strike the paper 19 where no printing exists, preventing marring or streaking of the printed portions on the paper 19.

The foregoing description of the invention has been directed to particular preferred embodiments in accordance with the requirements of the Patent Statutes and for the purpose of explanation and illustration. It will be apparent, however, to those skilled in this art that many modifications and changes in both the apparatus and method may be made without departing from the scope and spirit of the invention. For example, the particular shape of the bar 40 in the one embodiment of FIGS. 2, 3 and 4 and of the support 34 in that embodiment is unimportant so long as the bar 40 has a plurality of sides which form corners engageable by the teeth 46 and further, so long as the hollow portion in the bar 40 into which the support 34 fits, in combinations with the identical support on the opposing clip 26, will prevent the bar 40 from motion along its longitudinal axis as well as from rotation about its longitudinal axis. This fixes the position of the bar so that the location of the bearing surface 52 on each of the eccentric paper contacting members 42 can be adjusted with reference to the bar 40 position in order to select the location of the contact between the bearing surface 52 and the paper 19.

Further, the embodiment shown in FIG. 5 may have a gap as shown at 50 in FIG. 4, in order to facilitate sliding the eccentric paper contacting member 42 along the bar 40*a* and rotatably adjusting the position of the bearing surface 52, while enabling the smaller diameter of the surface 54 to frictionally bind the eccentric paper contacting member 42 against rotational or longitudinal movement when the force expanding the gap 50 is released to allow the gap 50 to return to its normal size, in the identical manner as is illustrated in FIG. 4.

In addition, those skilled in the art will realize that other suitable structures are possible for the clip 26 which would allow the clip 26 to be detachably mountable upon any link 24 in the chain 20, in a short amount of time while having a suitable means for supporting the bar 40, 40*a* against longitudinal motion and rotational motion about its longitudinal axis. For example, a suitable means for mounting the bar 40, 40A could be affixed to a spring loaded clamp, e.g., an aligator clip, which could in turn then be used to detachably mount the bar onto a link of the chain 20 in the chain delivery.

Another apparent modification to those skilled in the art would be to provide that the support 34 portion of the clip 26 have a hollow section into which is inserted a corresponding male portion of the bar 40, 40*a* of suitable size and shape to prohibit longitudinal motion of the bar 40, 40*a* and rotational motion of the bar 40, 40*a* about its longitudinal axis. In addition the bar 40*a* of the one embodiment of FIG. 5 could be attached to the clips in the same manner as the multisided bar 40 or by a frictional engagement to a support having a cylindkrical shape in a similar manner to the attachment of the eccentric paper contacting members 42 in the embodiment of FIG. 5.

It will also be understood by those skilled in the art that other suitable means are available for selectively rotating the individual eccentric paper contacting members 42 about the longitudinal axis of the bar 40, 40*a* and then locking the eccentric paper contacting members 42 at a desired position of the bearing surface 52 with respect to the bar 40, 40*a* during the normal operation of the chain delivery section.

It will further be apparent that the invention may also be utilized, with other suitable modifications within the state of the art which will be apparent to those skilled in this art. It is the Applicant's intention in the following claims to cover all such equivalent modifications and variations as fall within the true spirit and scope of the invention.

What is claimed is:

1. In the chain delivery of a printing apparatus having a pair of continuous chains, upon which chains are mounted a plurality of paper gripping members, and wherein the continuous chains include a plurality of pairs of links each pivotally connected by a pintle, the improvement in the means for engaging the paper as it passes into the chain delivery, which engaging occurs between the paper gripping members and prevents wrinkling of the paper, comprising:

a pair of opposing clips, each detachably mountable on one of the links of each of the chains, and including a support;

a bar, having a longitudinal axis, with hollow portions at each end defined by a plurality of inner surfaces, said bar being fixedly engaged by said support, each support having a plurality of outer surfaces corresponding to the plurality of inner surfaces of the hollow bar portion, and fixedly engaging the outer surfaces of the support, thereby preventing rotation of said bar about its longitudinal axis; and at least one paper contacting member longitudinally adjustably mounted on said bar, said member having an eccentric shape and a bearing surface at the apex of the eccentric shape, and said member being rotatably adjustable about said longitudinal axis, and having an internal opening in the eccentric containing a plurality of teeth coming into contact with the plurality of sides of said bar which define a plurality of corners, said teeth fixedly engaging at least one of the corners and holding the eccentric at a predetermined the operation of the chain delivery.

2. The apparatus of claim 1 wherein said eccentric has an internal opening containing a plurality of teeth, said plurality of sides defining a plurality of corners at the intersection of adjoining said sides, said teeth fixedly engaging at least one of said corners.

3. The apparatus of claims 1 or 2 wherein said eccentric has a gap, expansion of said gap permitting adjusting of the size of said internal opening, thereby allowing rotation of said eccentric about the longitudinal axis of said bar to a preselected position, and release of the expansion of said gap causing said teeth to engage said at least one of said corners.

4. In the chain delivery of a printing apparatus having a pair of continuous chains, upon which chains are mounted a plurality of paper gripping members, and wherein the continuous chains include a plurality of links each pivotally connected by a pintle, the improvement in the means for engaging the paper as it passes into the chain delivery, which engaging occurs between the paper gripping members and prevents wrinkling of the paper, comprising:

a pair of opposing clips, each detachably mountable onto one of the links of each of the chains, without the neked for an added protrusion on the link or to the pintle, and including a support;

a bar having a longitudinal axis, with hollow portions at each end defined by a plurality of inner surfaces, said bar being fixedly engaged by said support, each support having a plurality of outer surfaces corresponding to the plurality of inner surfaces of the hollow bar portion, and fixedly engaging the outer surfaces of the support, thereby preventing rotation of said bar about its longitudinal axis; and, at least one paper contacting member longitudinally adjustably mounted on said bar, said member having an eccentric shape and a bearing surface at the apex of the eccentric shape, and said member being rotatably adjustable about said longitudinal axis, and having an internal opening in the eccentric containing a plurality of teeth coming into contact with the plurality of sides of said bar which define a plurality of corners, said teeth fixedly engaging at least one of the corners and holding the eccentric at a predetermined position against further rotation during the operation of the chain delivery.

5. The apparatus of claims 4 or 2 wherein said eccentric has a gap, expansion of said gap permitting adjusting of the size of said internal opening, thereby allowing rotation of said eccentric about the longitudinal axis of said bar to a preselected position, and release of the expansion of said gap causing said teeth to engage said at least one of said corners.

* * * * *